United States Patent [19]

Daar et al.

[11] Patent Number: 5,011,485

[45] Date of Patent: Apr. 30, 1991

[54] DEPILATORY DEVICE

[76] Inventors: Yair Daar, Moshav Galia; Shimon Yahav, 90 Tchernokovsky Street, Rehovot, both of Israel

[21] Appl. No.: 385,881

[22] Filed: Jul. 27, 1989

[30] Foreign Application Priority Data

May 26, 1989 [IL] Israel ..... 90433

[51] Int. Cl.[5] ..... A61B 17/00

[52] U.S. Cl. ..... 606/133

[58] Field of Search ..... 606/133; 17/11.1 R, 17/47

[56] References Cited

U.S. PATENT DOCUMENTS

| | | |
|---|---|---|
| 1,232,617 | 7/1917 | Shipp . |
| 1,743,590 | 1/1930 | Binz . |
| 1,875,980 | 9/1932 | Bingham . |
| 1,923,415 | 8/1933 | Bingham . |
| 2,083,380 | 6/1937 | Hudson . |
| 2,112,230 | 3/1938 | Fisher . |
| 2,423,245 | 7/1947 | Magnus . |
| 2,458,911 | 1/1949 | Kerr . |
| 2,486,616 | 1/1949 | Schubiger . |
| 2,496,223 | 1/1950 | Lanzisera . |
| 2,592,484 | 4/1952 | Smith . |
| 2,900,661 | 8/1959 | Schnell . |
| 3,150,409 | 9/1964 | Wilcox . |
| 3,613,690 | 10/1971 | Newell . |
| 3,911,530 | 10/1975 | Kalfsbeek et al. . |
| 4,079,741 | 3/1978 | Daar et al. . |
| 4,171,701 | 7/1977 | Walter . |
| 4,279,253 | 4/1979 | Haes . |
| 4,524,772 | 6/1985 | Daar et al. . |
| 4,575,902 | 3/1986 | Alazet . |
| 4,726,375 | 2/1988 | Gross et al. . |
| 4,807,624 | 2/1989 | Gross et al. . |
| 4,825,867 | 5/1989 | Gross et al. . |
| 4,830,004 | 5/1989 | Alazet . |

FOREIGN PATENT DOCUMENTS

| | | |
|---|---|---|
| 2650969 | 6/1977 | Fed. Rep. of Germany . |
| 845847 | 12/1987 | Fed. Rep. of Germany . |
| 667265 | 10/1929 | France . |
| 788130 | 10/1935 | France . |
| 1017490 | 12/1952 | France . |
| 1123971 | 10/1956 | France . |
| 1151495 | 1/1958 | France . |
| 2245314 | 4/1975 | France . |
| 2307491 | 11/1976 | France . |
| 2334320 | 7/1977 | France . |
| 2454283 | 11/1980 | France . |
| 2556939 | 6/1985 | France . |
| 2598067 | 5/1986 | France . |
| 61702 | 10/1971 | Greece . |
| 179261 | 8/1935 | Switzerland . |
| 268696 | 9/1950 | Switzerland . |
| 652899 | 12/1985 | Switzerland . |
| 203970 | 9/1923 | United Kingdom . |
| 225445 | 12/1924 | United Kingdom . |

*Primary Examiner*—Michael H. Thaler

*Attorney, Agent, or Firm*—Finnegan, Henderson, Farabow, Garrett & Dunner

[57] ABSTRACT

A human hair depilatory device including a hand held portable housing, a first element arranged to be driven in rotational motion relative to skin bearing hair to be removed, the first element comprising a plurality of hair engaging locations at which adjacent hair engaging surfaces of the first element are spread apart when the hair engaging locations are disposed by rotation at a convex side and at which the adjacent hair engaging surfaces of the first element are moved relatively towards each other in hair engaging arrangement when the hair engaging locations are disposed by rotation at a concave side, the rotational motion of the first element producing motion of the hair engaging locations from the convex side to the concave side for engagement and removal of hair from the skin and a second element disposed interiorly of said first element and arranged to be driven in rotational motion and to define a hair support for hair engaged between adjacent hair engaging surfaces.

4 Claims, 12 Drawing Sheets

I
II
III
IV
V
VI
VII
VIII
A
B
10
12
14
15
16
20
22
24

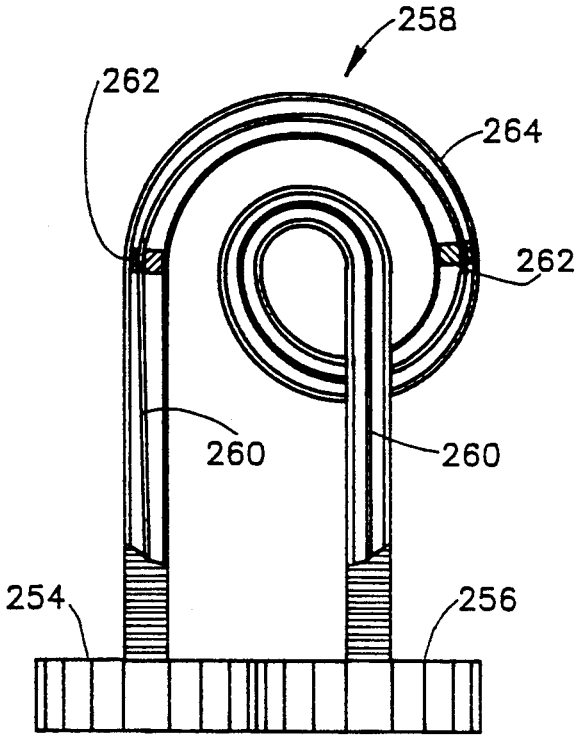
FIG.16B
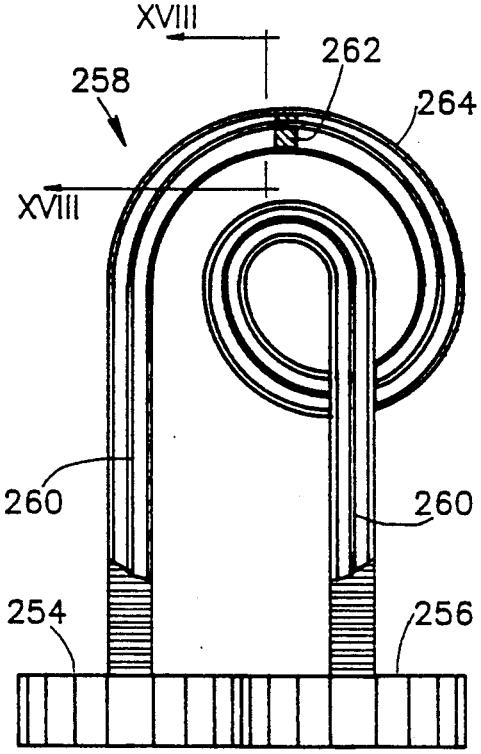
FIG.16A
FIG.17A
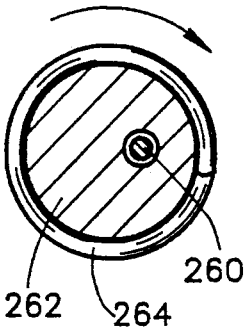
FIG.17B
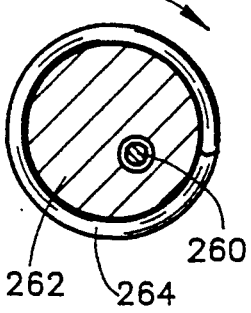
FIG.17C
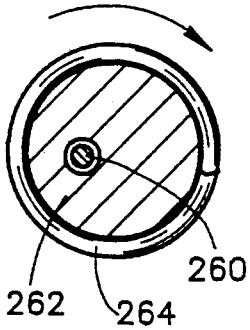
FIG.17D
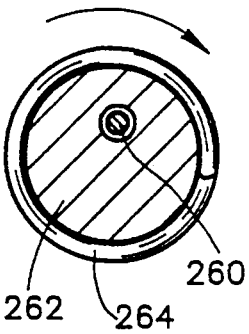
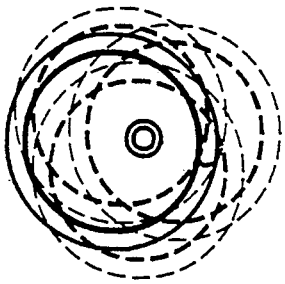
FIG.18

DEPILATORY DEVICE

FIELD OF THE INVENTION

The present invention relates to personal depilatory devices generally.

BACKGROUND OF THE INVENTION

Various types of depilatory apparatus are known in the art. One type of manually operated device, exemplified in U.S. Pat. Nos. 2,458,911, 2,486,616 and 1,743,590 and Swiss Patent 268,696, employs a coil spring which engages hairs in spaces between the convolutions thereof and pulls the hair away from the skin as the spaces between the convolutions are closed. The operation of this type of device is highly inefficient, slow and painful.

Early power driven depilatory devices are exemplified in U.S. Pat. No. 4,079,741 of present Applicants. U.S. Pat. No. 4,079,741 describes a hair removal device employing an axially disposed helical spring which is simultaneously driven in axial rotation by an electric motor and reciprocatingly compressed and extended by a cam operated by the electric motor. This apparatus is relatively complex and costly and has not reached the market.

A highly successful power driven depilatory device is described in Applicant's U.S. Pat. No. 4,524,772 which shows an electrically powered depilatory device including a hand-held portable housing, motor apparatus disposed in the housing and a helical spring comprising a plurality of adjacent windings arranged to be driven by the motor apparatus in rotational sliding motion relative to skin bearing hair to be removed, the helical spring including an arcuate hair engaging portion arranged to define a convex side corresponding thereto whereat the windings are spread apart and a concave side corresponding thereto whereat the windings are pressed together, the rotational motion of the helical spring producing continuous motion of the winding from a spread-apart orientation at the convex side to a pressed together orientation at the concave side and for engagement and plucking of hair from the skin, whereby the surface velocities of the windings relative to the hair greatly exceed the surface velocity of the housing relative thereto.

SUMMARY OF THE INVENTION

The present invention seeks to provide a power driven personal depilatory device having enhanced hair removing capabilities while lowering user discomfort.

There is thus provided in accordance with a preferred embodiment of the present invention a human hair depilatory device including a hand held portable housing, a first element arranged to be driven in rotational motion relative to skin bearing hair to be removed, said first element including a plurality of hair engaging locations at which adjacent hair engaging surfaces of the first element are spread apart when the hair engaging locations are disposed by rotation at a convex side and at which the adjacent hair engaging surfaces of the first element are moved relatively towards each other in hair engaging arrangement when the hair engaging locations are disposed by rotation at a concave side, the rotational motion of the first element producing motion of the hair engaging locations from the convex side to the concave side for engagement and removal of hair from the skin and a second element disposed interiorly of the first element and arranged to be driven in rotational motion and to define a hair support for hair engaged between adjacent hair engaging surfaces.

Further in accordance with a preferred embodiment of the invention there is provided a human hair depilatory device including a hand held portable housing, a first element arranged to be driven in rotational motion relative to skin bearing hair to be removed, said first element including a plurality of hair engaging locations at which adjacent hair engaging surfaces of the first element are spread apart when the hair engaging locations are disposed by rotation at a convex side and at which the adjacent hair engaging surfaces of the first element are moved relatively towards each other in hair engaging arrangement when the hair engaging locations are disposed by rotation at a concave side, the rotational motion of the first element producing motion of the hair engaging locations from the convex side to the concave side for engagement and removal of hair from the skin and a second element disposed interiorly of the first element and arranged to define a hair path defining support for hair engaged between adjacent hair engaging surfaces, the hair path defining support causing the engaged hair to extend along a generally arcuate path.

In accordance with a preferred embodiment of the invention, the second element is operative such that the length of hair which may be tensioned by engagement with the hair engaging surfaces of the first element sufficiently to enable removal thereof from the skin is effectively increased by the provision of the second element.

According to one embodiment of the invention, the second element is arranged to be driven in rotational motion by the first element.

Further in accordance with an embodiment of the invention the second element is arranged to be driven in rotational motion with the first element.

Additionally in accordance with an embodiment of the invention, the hair support has a radius which is at least one quarter of the radius of the first element.

Further in accordance with an embodiment of the invention the hair support has a radius which is at least one half of the radius of the first element.

In accordance with a preferred embodiment of the invention, the hair support has a radius which is at least three quarters of the radius of the first element.

Additionally in accordance with a preferred embodiment of the present invention, the human hair depilatory device also includes a generally stationary third element disposed interiorly of the first and second elements.

Further in accordance with the foregoing embodiment of the invention, the human hair depilatory device further includes at least one fourth element disposed intermediate the second and third elements for providing desired spacing therebetween.

In accordance with a preferred embodiment of the invention, the first element comprises a helical spring. The first element may comprise a multiplicity of adjacent disks. The first element may comprise a unitary element. Alternatively, the first element may comprise a plurality of discrete elements which cooperate for hair engagement.

In accordance with a preferred embodiment of the present invention, the first and second elements have generally circular cross sections and the radius of the circular cross section of the second element is nearly as large as that of the first element.

In accordance with an embodiment of the present invention, there is provided a human hair depilatory, device including a hand held portable housing, a hair engagement element arranged to be driven in rotational motion relative to skin bearing hair to be removed for engagement and removal of the hair from the skin, and apparatus for causing the hair engagement element to undergo vibration.

In accordance with an embodiment of the invention there is provided a human hair depilatory device including a hand held portable housing, a hair engagement element arranged to be driven in rotational motion relative to skin bearing hair to be removed for engagement and removal of the hair from the skin and apparatus for applying vibrations to the skin during hair engagement and removal.

In accordance with an embodiment of the present invention, there is provided a human hair depilatory device including a hand held portable housing, a hair engagement element arranged to be driven in rotational motion relative to skin bearing hair to be removed, said hair engagement element including a plurality of hair engaging locations at which adjacent hair engaging surfaces of the hair engagement element are spread apart when the hair engaging locations are disposed by rotation at a convex side and at which the adjacent hair engaging surfaces of the first element are moved relatively towards each other in hair engaging arrangement when the hair engaging locations are disposed by rotation at a concave side, the rotational motion of the hair engagement element producing motion of the hair engaging locations from the convex side to the concave side for engagement and removal of hair from the skin and apparatus for causing the hair engagement element to undergo vibration having a component of amplitude lying in a plane of rotation thereof.

In accordance with one embodiment of the present invention, the apparatus for causing comprises at least one element mounted internally of the hair engagement element.

In accordance with a preferred embodiment of the invention, the at least one element comprises a spacer disk eccentrically mounted on a stationary element located within the hair engagement element.

In accordance with an alternative embodiment of the invention, the apparatus for causing comprises a rotatable element which periodically engages the hair engagement element.

In accordance with a further alternative embodiment, the apparatus for causing comprises apparatus for skewed mounting of the hair engagement element whereby rotation thereof produces oscillation thereof.

Further in accordance with a preferred embodiment of the invention there is provided a human hair depilatory device including a hand held portable housing and a hair engagement element arranged to be driven in rotational motion relative to skin bearing hair to be removed for engagement and removal of the hair from the skin and being configured to undergo vibration as it depilates. According to one embodiment, the hair engagement element may be configured to define a plurality of mutually offcenter sections.

In accordance with a preferred embodiment of the invention, the hair engagement element comprises a helical spring.

BRIEF DESCRIPTION OF THE DRAWINGS

The present invention will be understood and appreciated more fully from the following detailed description, taken in conjunction with the drawings in which:

FIGS. 16A and 16B are illustrations of two alternative versions of a depilatory device constructed and operative in accordance with another preferred embodiment of the present invention and having a vibratory movement;

FIGS. 17A–17D are illustrations of the operation of the apparatus of FIGS. 16A and 16B;

FIG. 18 is a superimposed sectional illustration taken along lines XVIII—XVIII of FIG. 16A, illustrating the eccentric motion of the depilatory device;

DETAILED DESCRIPTION OF A PREFERRED EMBODIMENT

Figures 1, 2:
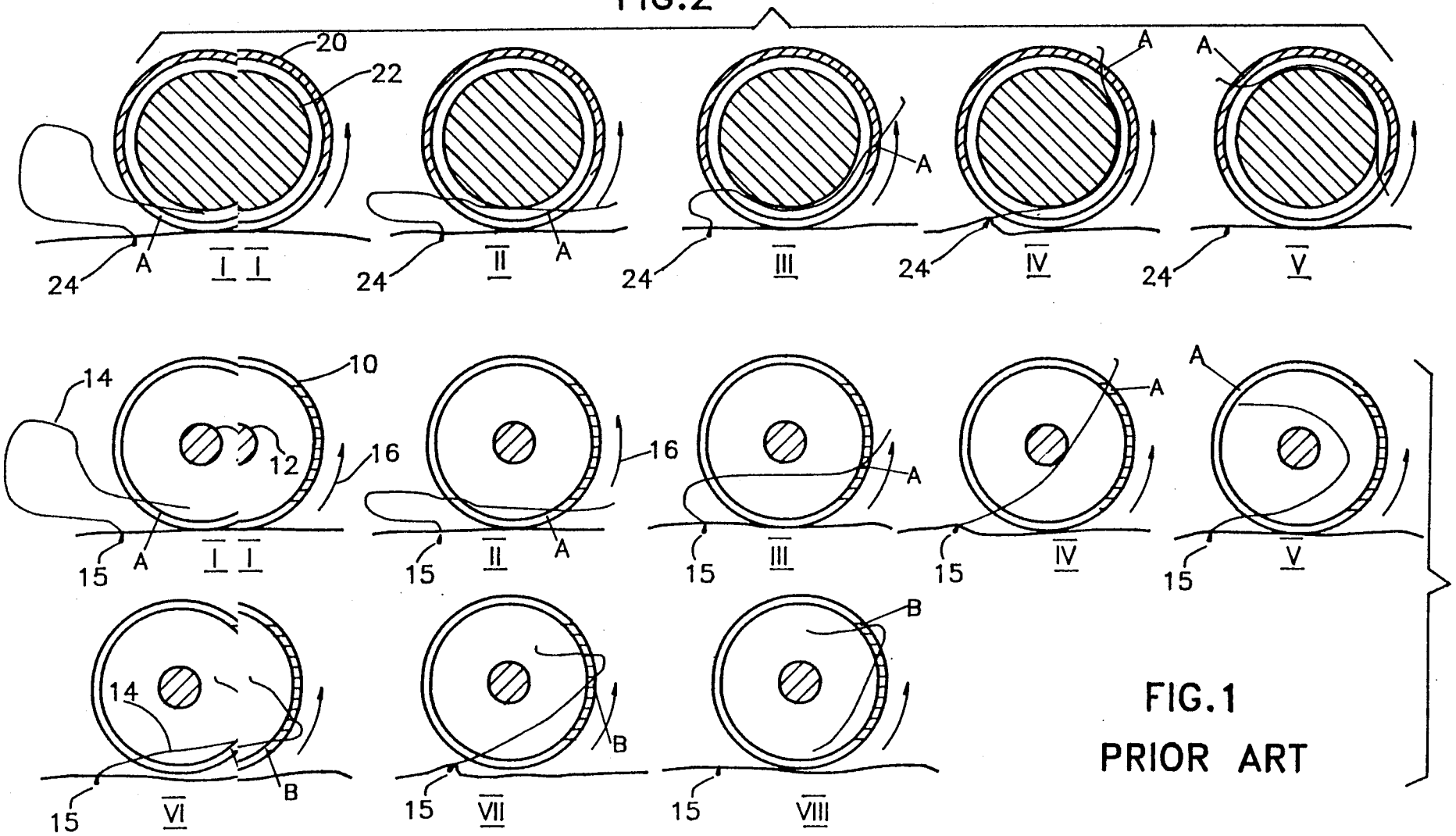
FIG.1 PRIOR ART
FIG. 1 is an illustration of stages of operation of prior art depilatory apparatus.
FIG. 2 is a generalized illustration of stages of operation of depilatory apparatus constructed and operative in accordance with a preferred embodiment of the present invention.

The present invention relates generally to a human hair depilatory device of the type illustrated generally in FIGS. 6, 13, 15A or 15B. The overall structure of the device may be summarized as including a hand held portable housing, a first element arranged to be driven in rotational motion relative to skin bearing hair to be removed, the first element including a plurality of preferably arcuate hair engaging locations at which adjacent hair engaging surfaces of the first element are spread apart when the hair engaging locations are disposed by rotation at a convex side and at which the adjacent hair engaging surfaces of the first element are moved relatively towards each other in hair engaging arrangement when the hair engaging locations are disposed by rotation at a concave side, the rotational motion of the first element producing motion of the hair engaging locations from the convex side to the concave side for engagement and removal of hair from the skin.

In accordance with an embodiment of the present invention there is provided a second element disposed interiorly of the first element to define a hair support for hair engaged between adjacent hair engaging surfaces. Various constructional and operational characteristics of the second element which enable it to reduce pain encountered during use of the depilatory device will be described hereinbelow in detail.

Prior art devices and particularly a human hair depilatory device constructed and operative in accordance with U.S. Pat. No. 4,524,772 of the present inventors employ a helical spring and a fixed interior guiding element indicated respectively in FIG. 1 as elements 10 and 12. In the prior art, the arrangement of the helical spring is such that at the concave side only a portion of the spring windings lie sufficiently close together to enable gripping of most human hair therebetween. This portion typically covers about 25% of the perimeter of the spring 10, and is indicated by cross-hatching in the drawing of FIG. 1. The interior guiding element 12 has an outer diameter which is less than one quarter of the outer diameter of the helical spring.

The operation of the prior art apparatus for a relatively long human hair is illustrated in FIG. 1 Stage I shows a hair 14, having a root location 15, engaged between windings of the spring but not grasped thereby. Stage II illustrates the hair 14 being drawn along with the spring windings as they rotate in the direction indicated by arrow 16. Stage III illustrates the hair being grasped between the spring windings within the cross-hatched grasping region at a grip location A.

At stage IV, tensioning of the hair is shown, as location A rotates further away from the root location 15, producing pulling on the skin in the vicinity of the root, and resulting normally in some pain. The illustrated tensioning, while sufficient to produce some pain, is not sufficient to remove the hair from the skin because the length of the hair between the location on the hair at which the hair is gripped and root location 15 is not sufficiently less than the length of the shortest path between location A at stage IV and the root location along which the hair can lie.

It is noted that the presence of interior element 12 does not appreciably increase the length of the shortest path along which the hair can lie between location A and the root location.

Accordingly, following stage IV, the hair 14 is released in stage V. Thereafter, it may occur that the same hair is again engaged at a location closer to its root location 15 and gripped by the spring windings at a grip location B, as illustrated in stage VI. The hair is tensioned in stage VII, producing pain. This time, however, the hair is removed, as illustrated in stage VIII, because the length of the hair between the location on the hair at which the hair is gripped and root location 15 is sufficiently less than the length of the shortest path along which the hair can lie between location B, intermediate stages VII and VIII, and the root location.

It may thus be appreciated that in the prior art, multiple tensionings with attendant pain may be encountered before relatively long hair is in fact removed.

The present invention will now be described with reference to FIG. 2. It will be shown for example that hair of length within a given range which would have been tensioned and then released without being removed using the prior art apparatus, is removed using the depilatory apparatus of the present invention.

The embodiment of FIG. 2 comprises a first element 20, which is preferably a helical spring but which may alternatively be any other suitable element, including a plurality of hair engaging locations at which adjacent hair engaging surfaces of the first element are spread apart when the hair engaging locations are disposed by rotation at a convex side and at which the adjacent hair engaging surfaces of the first element are moved relatively towards each other in hair engaging arrangement when the hair engaging locations are disposed by rotation at a concave side, the rotational motion of the first element producing motion of the hair engaging locations from the convex side to the concave side for engagement and removal of hair from the skin.

According to a preferred embodiment of the present invention illustrated in FIGS. 2 and 6–9, the arrangement of the first element is such that along about preferably 75% of the perimeter of the first element, the hair engaging surfaces lie sufficiently close together to enable gripping of most human hair therebetween. This portion is indicated by cross-hatching in the drawing of FIG. 2.

In the embodiment of FIG. 2, as compared with the prior art represented in FIG. 1, there is provided a second, interior, element 22 which causes hair grasped by the first element to lie along a path which is preferably generally parallel to the perimeter of the first element In accordance with the present invention, the second element appreciably increases the length of the shortest path along which the hair can lie between location A and the root location, in contrast to the prior art.

Referring now to FIG. 2 it can be seen that stage I is essentially the same as stage I of the operation of the prior art apparatus, shown in FIG. 1. Comparing stages II and III of the embodiment of FIG. 2 and of the prior art, it is seen that the configuration of the second element 22 constrains the hair to extend along a path between the hair root location 24 and a grip location A which is longer than the shortest path between those two locations.

Accordingly, when the hair is tensioned, as illustrated in stage IV, shown in FIG. 2, the hair generally follows the curvature of the second element 22 defining a much longer path than the corresponding "short cut" along which the hair extends in stage IV of FIG. 1. It can be seen therefore that when grip location A is in the same position in FIG. 1 and FIG. 2, the hair is pulled under tension a longer distance in the embodiment of FIG. 2 than in the prior art shown in FIG. 1. This can be seen at stage IV by observing that, in FIG. 2, the skin is shown deformed near the root much more than in FIG. 1.

It is an additional preferred feature of the invention that the percentage of the perimeter of the first element along which hair is gripped between adjacent hair engaging surfaces is increased in the present invention as compared with the prior art. According to a preferred embodiment of the invention, hair is gripped along about three-quarters of the perimeter of the first element while in the prior art embodiment shown in FIG. 1, the percentage is generally only about 25%.

The increased percentage of perimeter along which gripping takes place, when combined with provision of the second element according to the present invention, further increases the distance along which the hair is pulled under tension, thus further increasing the likelihood that a hair will be removed when it is tensioned.

Thus, as seen in stage V, the hair is removed upon being tensioned the first time, and subsequent tensioning or tensionings of the hair as shown in stages VI, VII and VIII in FIG. 1 are obviated.

Reference is now made to FIGS. 3A–3I and FIGS. 4A–4I corresponding thereto, which illustrate a plurality of alternative embodiments of depilatory apparatus useful in the present invention. It will be appreciated that the selection of embodiments illustrated herein is not intended to be exhaustive but rather exemplary. For example, although the first element is shown herein as a helical spring, it may alternatively be any other type of spring or any other suitable element or collection of elements which are operative to engage hair as described above.

Figure 3A:
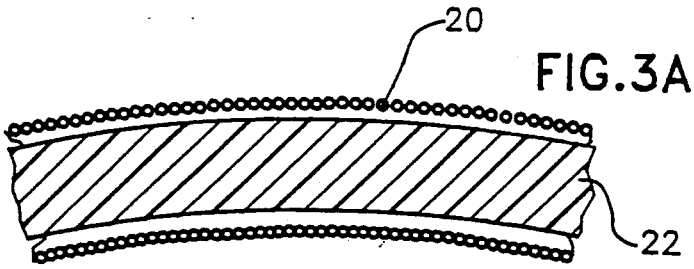
FIGS. 3A, 3B, 3C, 3D, 3E, 3F, 3G, 3H and 3I are sectional illustrations of nine alternative embodiments of depilatory apparatus constructed and operative in accordance with a preferred embodiment of the present invention.
Figure 4A:
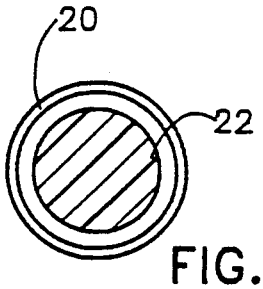
FIGS. 4A, 4B, 4C, 4D, 4E, 4F, 4G, 4H and 4I are cross sectional illustrations of the nine alternative embodiments of depilatory apparatus constructed and operative in accordance with a preferred embodiment of the present invention, illustrated in FIGS. 3A, 3B, 3C, 3D, 3E, 3F, 3G, 3H and 3I.

FIGS. 3A and 4A illustrate an embodiment wherein the first element 20 typically comprises a helical spring and the second element 22 typically comprises a solid, resilient, generally cylindrical element typically formed of plastic. Here the ratio between the outer diameters of the second element and of the first element is approximately 7:10.

Figure 3B:
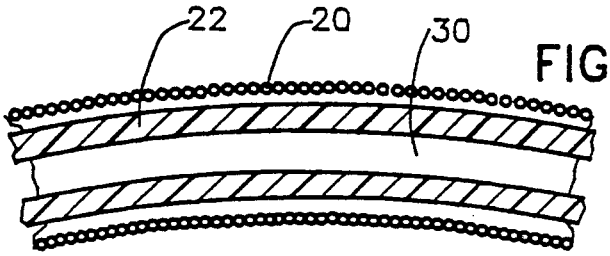
Figure 4B:
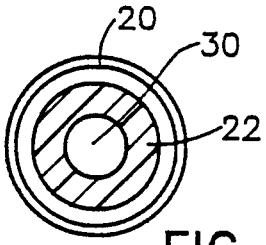

FIGS. 3B and 4B illustrate an embodiment generally similar to that of FIGS. 3A and 3B wherein the second element 22, instead of being solid, has a central aperture or bore 30.

Figure 3C:
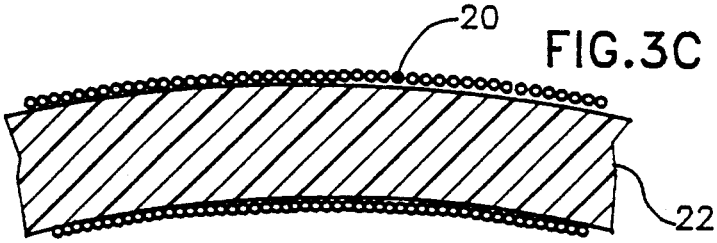
Figure 4C:
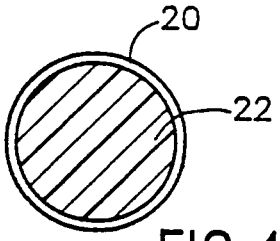

FIGS. 3C and 4C illustrate an embodiment generally similar to that of FIGS. 3A and 4A but wherein the ratio between the outer diameters of the second element and of the first element is greater than in the embodiment of FIGS. 3A and 3B. In the embodiment of FIGS. 3C and 4C, the first and second elements may be touching and may be in frictional engagement such that rotation of the first element also drives the second element for rotation therewith, with or without slippage.

Figure 3D:
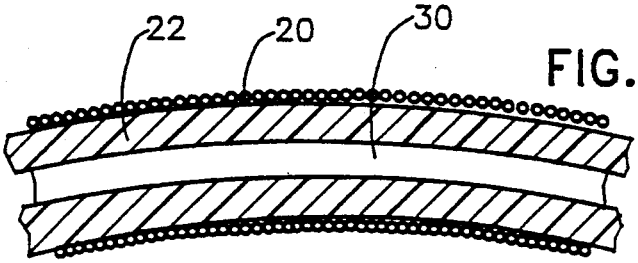
Figure 4D:
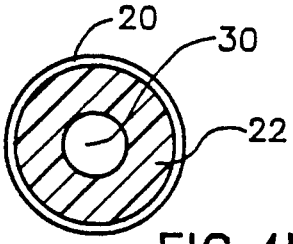

FIGS. 3D and 4D illustrate an embodiment corresponding to the embodiment of FIGS. 3C and 4C but wherein the second member 20, instead of being solid, is formed with a central aperture or bore 30.

Figure 3E:
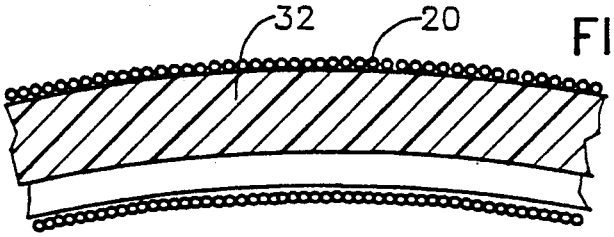
Figure 4E:
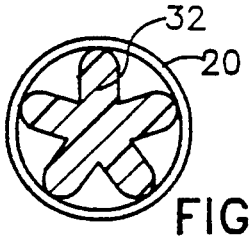

FIGS. 3E and 4E illustrate an embodiment wherein the first element is typically a helical spring and the second element is an elongate body 32, typically formed of plastic, having a generally star-shaped cross section.

Figure 3F:
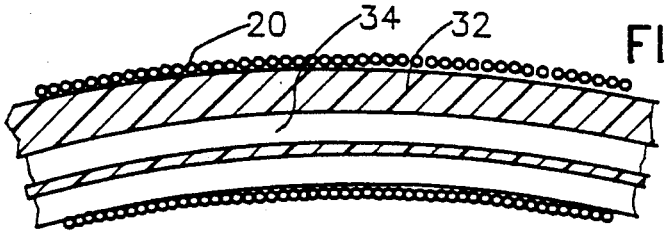
Figure 4F:
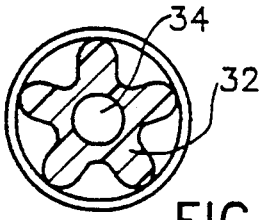

FIGS. 3F and 4F illustrate an embodiment, similar to that of FIGS. 3E and 4E but wherein a central aperture or bore 34 is formed in body 32.

Figure 3G:
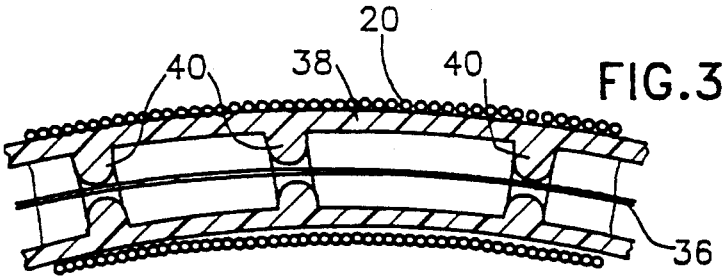
Figure 4G:
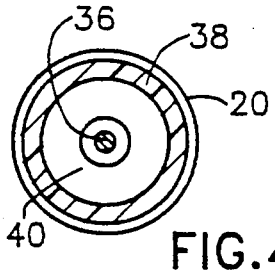

FIGS. 3G and 4G illustrate an embodiment somewhat similar to that of FIGS. 3D and 4D wherein a third element 36, typically in the form of a fixed guide wire, is disposed interiorly of a hollow second element 38. Desired location of the second element about the third element 36 is provided by a plurality of spacing rings 40 which are typically integrally formed with second element 38 and extend radially inward into the hollow portion thereof.

Figure 3H:
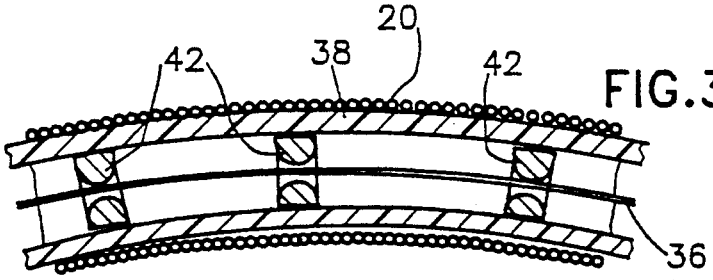
Figure 4H:
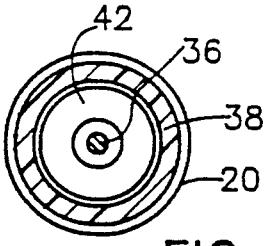

FIGS. 3H and 4H illustrate an alternative embodiment of the general configuration of FIGS. 3G and 4G wherein the spacing rings are not integrally formed with the hollow second element 38 but are instead discrete elements 42.

Figure 3I:
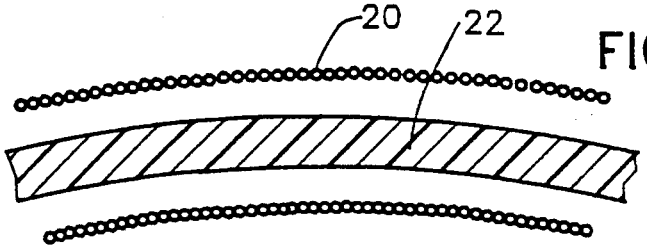
Figure 4I:
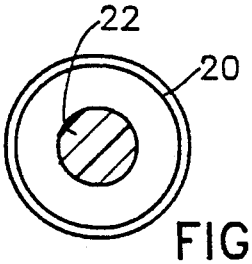

FIGS. 3I and 4I illustrate an embodiment of the general type shown in FIGS. 3A and 4A but wherein the ratio of the diameter of the second element 22 to the diameter of the first element 20 is smaller, preferably as low as 1:4.

Figure 5A:
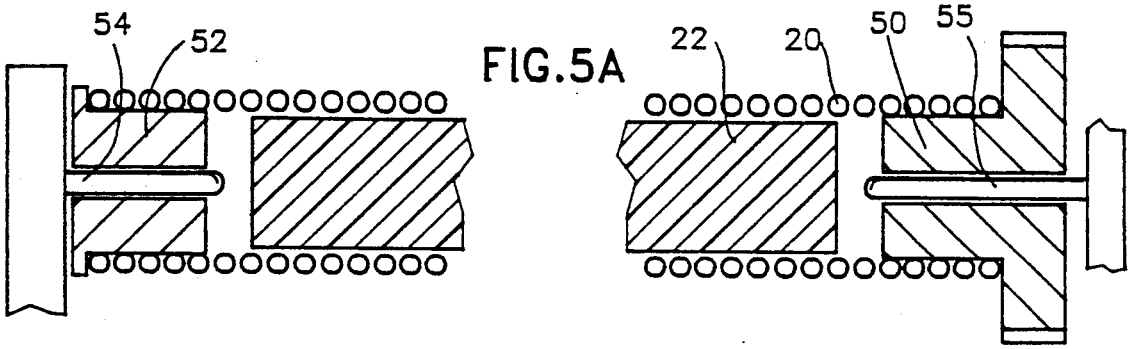
FIGS. 5A, 5B, 5C and 5D are partially cut away sectional illustrations of the mounting of four alternative embodiments of depilatory apparatus illustrated respectively in FIGS. 3A, 3D, 3H and 3I.

Reference is now made to FIGS. 5A–5D which illustrate various mounting arrangements for the depilatory apparatus described above. FIG. 5A illustrates mounting of apparatus of the general configuration illustrated in FIGS. 3A and 4A. It may be seen that one end of the first element 20 is drivingly mounted onto a drive gear 50, while the opposite end of first element 20 is similarly mounted onto a rotatable support element 52. Drive gear 50 and support element 52 are rotatably mounted on respective fixed pin supports 55 and 54. The second element 22 is not directly mounted onto either of elements 50 and 52 but is supported by first element 20 and is normally driven for rotation by the rotation thereof.

Figure 5B:
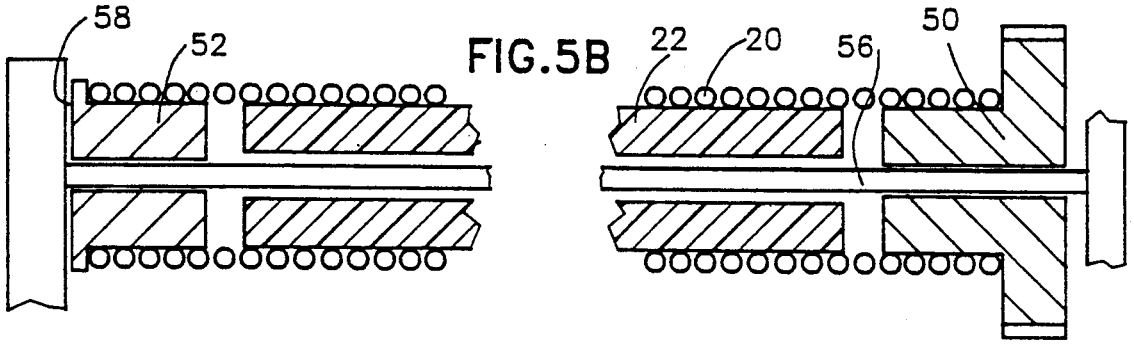

FIG. 5B illustrates a mounting configuration for apparatus of the general configuration illustrated in FIGS. 3B and 4B with the addition of a fixed wire 56. Fixed wire 56 provides a rotatable mounting for drive gear 50 and for rotatable support element 52 and defines the overall configuration of elements 20 and 22.

Figure 5C:
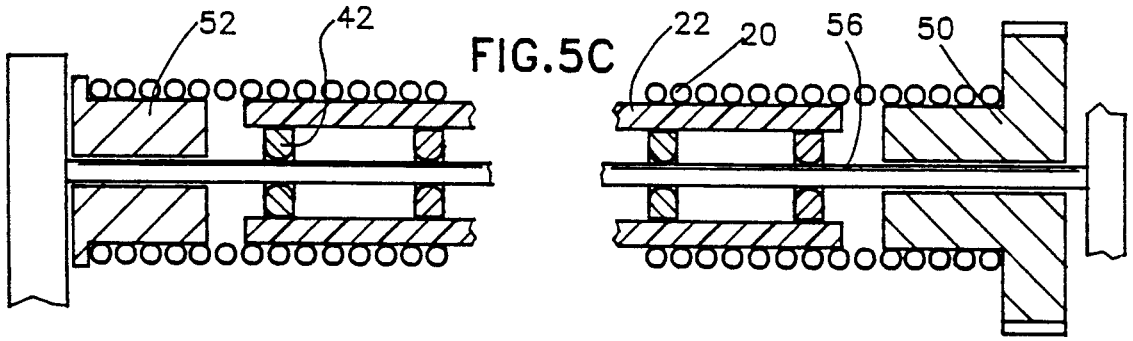

FIG. 5C illustrates a mounting configuration for apparatus of the general configuration of FIGS. 3H and 4H and is similar to the mounting illustrated in FIG. 5B, except that spacing rings 42 rotate relative to the fixed wire 56.

Figure 5D:
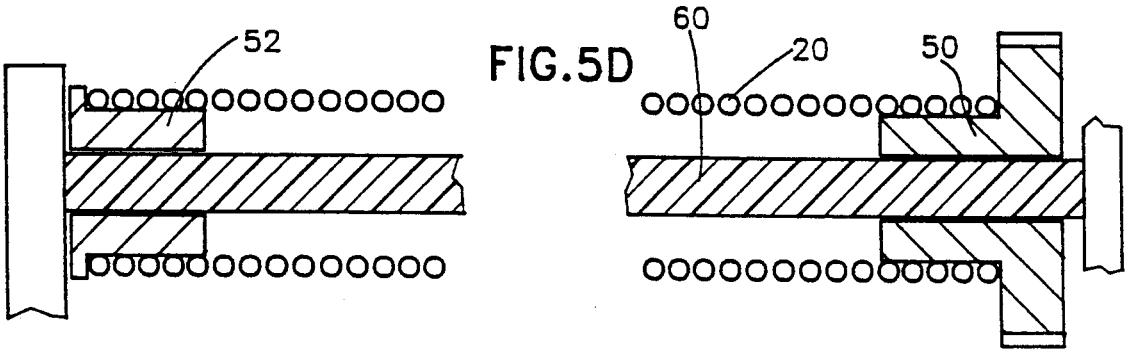

FIG. 5D illustrates a mounting configuration for apparatus of the general type illustrated in FIGS. 3I and 4I which differs from the mounting arrangement of FIGS. 5A and 5B in that both drive gear 50 and rotatable support element 52 are rotatably mounted on the second element, here designated by reference numeral 60, which is here typically formed of metal.

According to a preferred embodiment of the invention the second element is arranged for rotation. In the embodiments of FIGS. 3A–3H and 4A–4H, the second element may be driven for rotation by the first element via frictional engagement therebetween. According to an alternative embodiment of the invention, the second element may be arranged to be stationary. Such an arrangement is shown in the embodiment of FIGS. 3I, 4I, and 5D.

Reference is now made to FIGS. 6–12 which illustrate a preferred embodiment of depilatory device constructed and operative in accordance with a preferred embodiment of the invention.

The depilatory apparatus comprises a housing 70, typically formed of an impact resistant plastic material, which housing is configured to be hand-held in use. The housing 70 defines a body portion 72 which is typically integrally formed with an operating head support portion 74.

Figure 7:
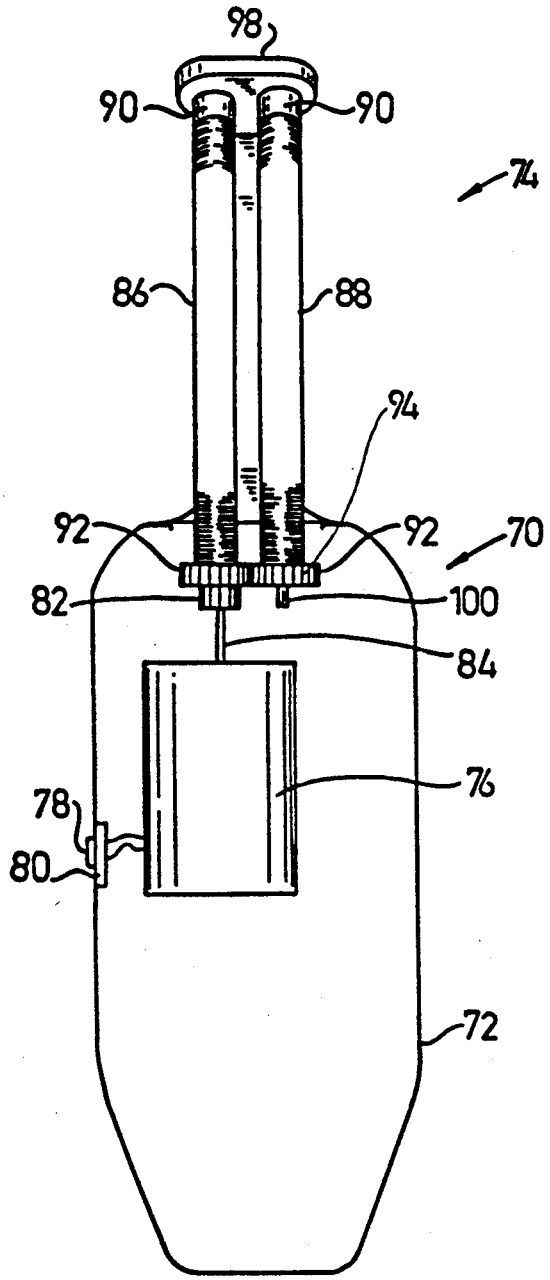
FIG. 7 is a front view of the interior of the depilatory device of FIG. 6.

Mounted interiorly of the body portion 72 of housing 70 is an electric motor 76 (FIG. 7). The operation of motor 76 is controlled by a manually operable switch plate 78 which is disposed outside of housing 70 and connected to a switch 80 associated with motor 76. Motor 76 drives a gear 82, which is fixedly mounted onto the shaft 84 of motor 76.

First and second generally elongate helical springs 86 and 88 or other suitable first elements are fixedly attached at one end thereof to centrally apertured rotatable end members 90 and at an opposite end thereof to apertured end members 92 having gear teeth 94 on their cylindrical edge surfaces. Disposed interiorly of and generally coaxially with helical springs 86 and 88 are second elements operative as described above. Examples of suitable second elements are illustrated in FIGS. 3A–3I and 4A–4I.

Helical springs 86 and 88 are rotatably mounted onto housing 70 by means of mounting pins 96 (FIG. 9) which are fixedly located at an extreme end 98 of head support portion 74 and by means of mounting pins 100 which are fixedly located in housing 70, as illustrated. Mounting pins 96 each rotatably engage an aperture formed in a respective rotatable end member 90 while mounting pins 100 each rotatably engage an aperture formed in a respective rotatable end member 92.

Figure 11:
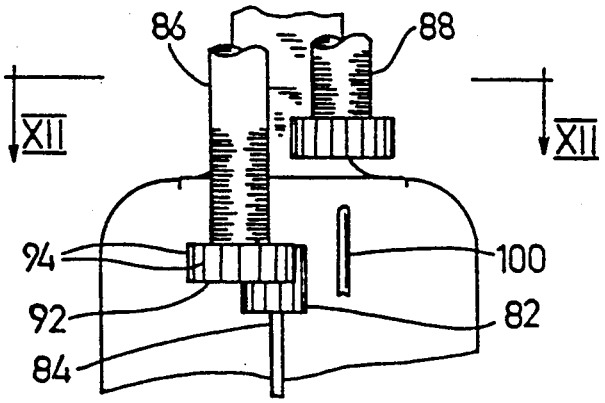
FIG. 11 is a pictorial illustration of the removable engagement of helical springs at a driven end thereof with the housing of the depilatory device in the embodiment of FIGS. 6–10.
Figure 12:
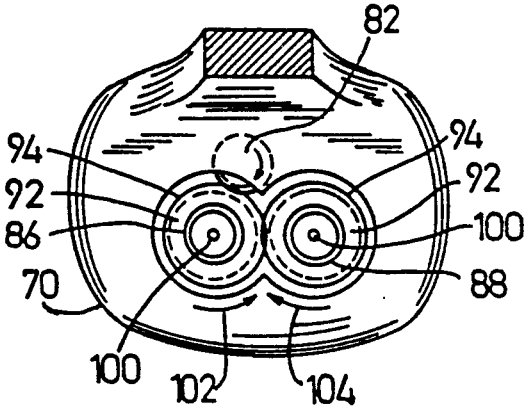
FIG. 12 is a sectional illustration of the engagement shown in FIG. 11, taken along the lines XII—XII in FIG. 11.

As seen particularly in FIGS. 11 and 12, the arrangement of pins 100 is such that the gear teeth of end members 92 are drivingly engaged and that the gear teeth of one of end members 92 are drivingly engaged by gear 82. In this way, springs 86 and 88 are driven in respective opposite directions, as indicated by arrows 102 and 104.

If desired, the springs 86 and 88 and associated end members may be arranged for easy removal and replacement.

Figure 13:
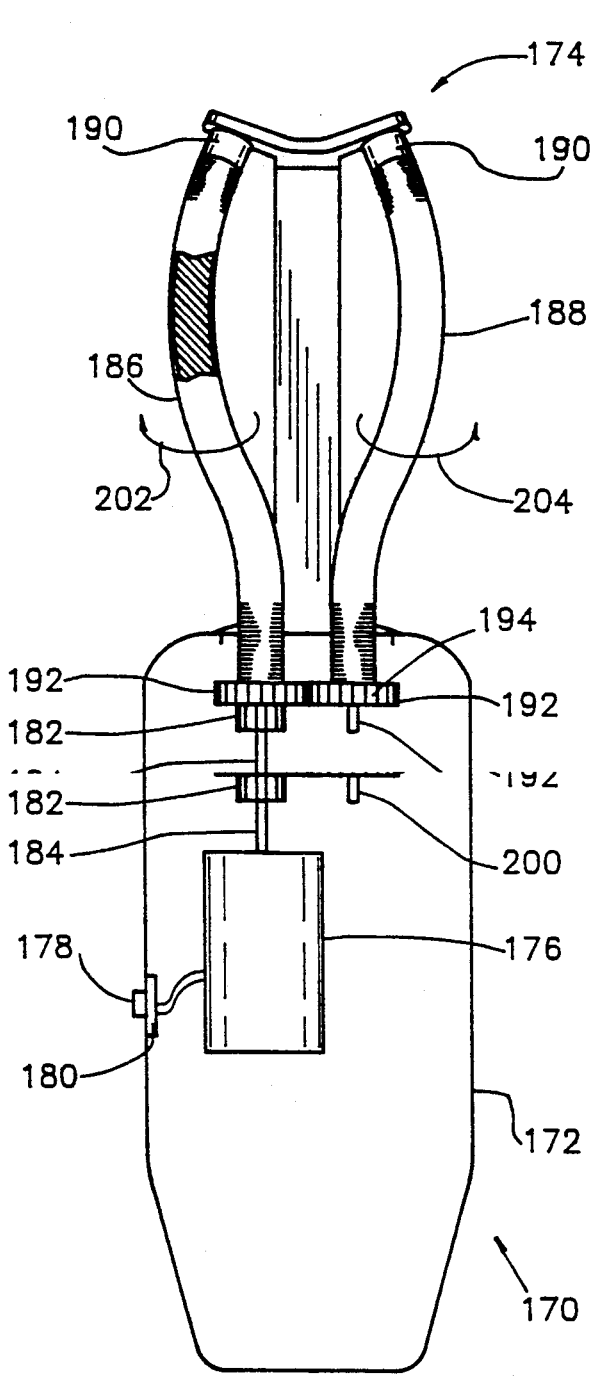
FIG. 13 is a cut away front view of a depilatory device constructed and operative in accordance with an additional embodiment of the invention.
Figure 14:
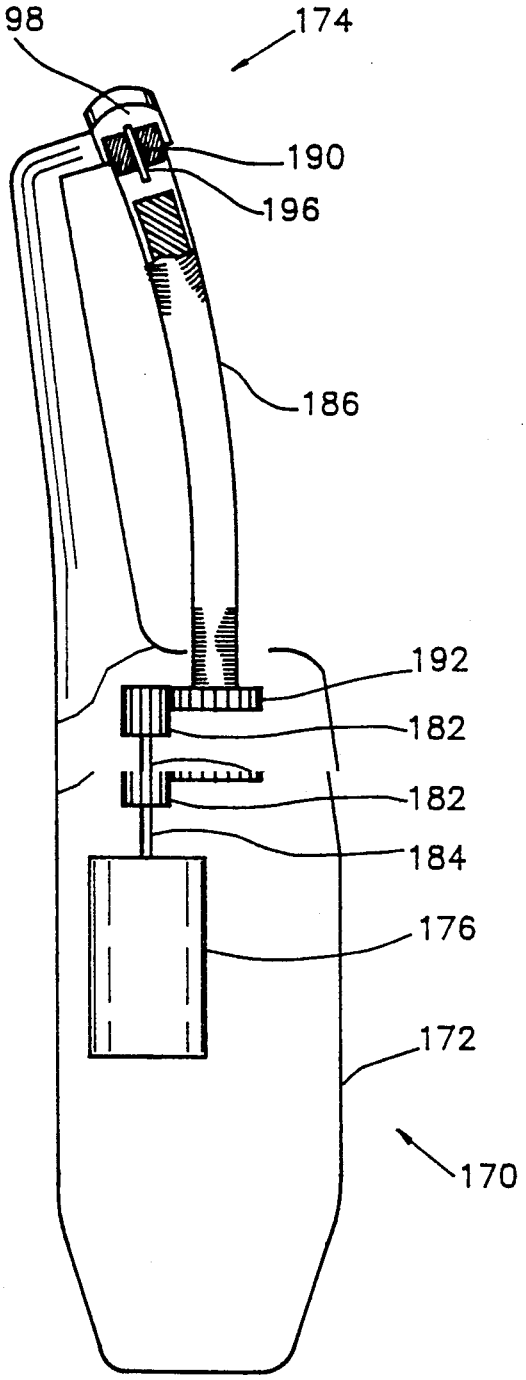
FIG. 14 is a cut away side view corresponding to the front view of FIG. 13.

Reference is now made to FIGS. 13 and 14, which illustrate an alternative embodiment of depilatory device. The depilatory apparatus comprises a housing 170, typically formed of an impact resistant plastic material, which housing is configured to be hand-held in use. The housing 170 defines a body portion 172 which is typically integrally formed with an operating head support portion 174.

Mounted interiorly of the body portion 172 of housing 170 is an electric motor 176. The operation of motor 176 is controlled by a manually operable switch plate 178 which is disposed outside of housing 170 and connected to a switch 180 associated with motor 176. Motor 176 drives a gear 182, which is fixedly mounted onto the shaft 184 of motor 176.

First and second generally elongate helical springs 186 and 188 are fixedly attached at one end thereof to centrally apertured rotatable end members 190 and at an opposite end thereof to apertured end members 192 having gear teeth 194 on their cylindrical edge surfaces.

Helical springs 186 and 188 are rotatably mounted onto housing 170 by means of mounting pins 196 (FIG. 14) which are fixedly located at an extreme end 198 of head support portion 174 and by means of mounting pins 200 (FIG. 13) which are fixedly located in housing 170, as illustrated. Mounting pins 196 each rotatably engage an aperture formed in a respective rotatable end member 190 while mounting pins 200 each rotatably engage an aperture formed in a respective rotatable end member 192.

As seen particularly in FIG. 13, the arrangement of pins 200 is such that the gear teeth of end members 192 are drivingly engaged and that the gear teeth of one of end members 192 are drivingly engaged by gear 182. In this way, springs 186 and 188 are driven in respective opposite directions, as indicated by arrows 202 and 204.

As in the embodiment of FIGS. 6–12, the provision of stiffening wires is not essential for maintaining the springs in predetermined generally arcuate orientation. The springs 186 and 188 and associated end members may be arranged for easy removal and replacement.

Figure 6:
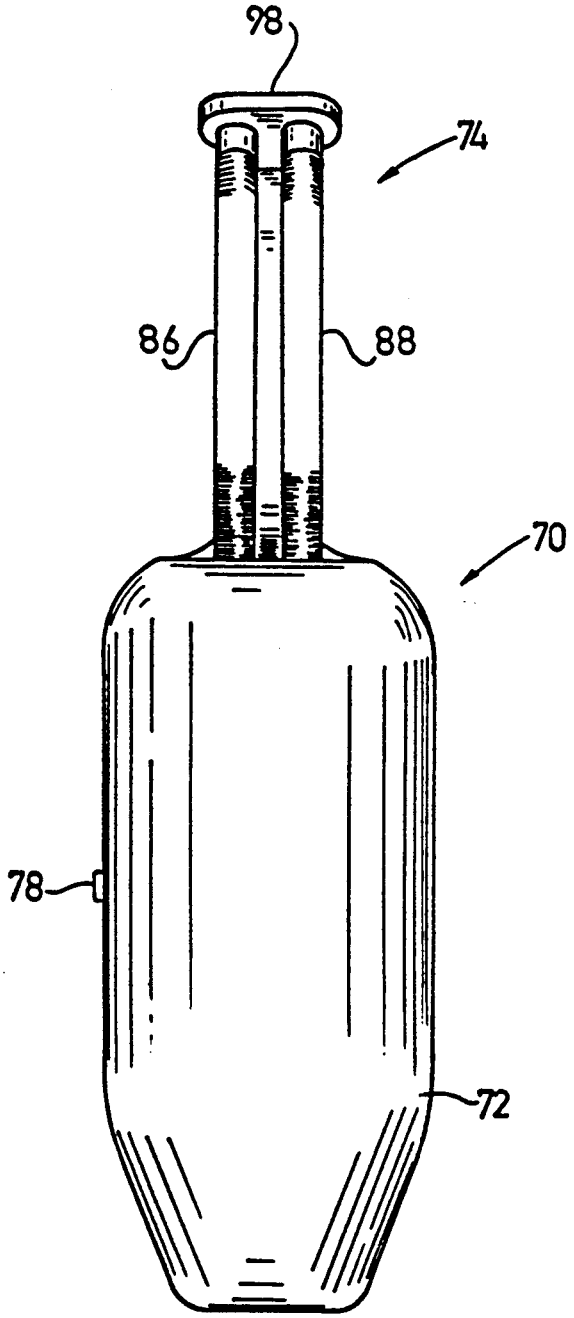
FIG. 6 is a front view of the exterior of a depilatory device constructed and operative in accordance with an embodiment of the invention.

As distinct from the embodiment of FIGS. 6–12 in which the springs 86 and 88 are in a generally parallel orientation as seen best in FIGS. 6 and 7, in the embodiment of FIGS. 13 and 14 the springs 186 and 188 are arranged in a spread-apart orientation, typically a convex orientation as illustrated such that end members 190 and 192 are closer together than are the midsections of springs 186 and 188. It is noted that springs 186 and 188 may lie in a plane or preferably may be somewhat curved, as can be appreciated from a consideration of FIG. 14.

Figure 15B:
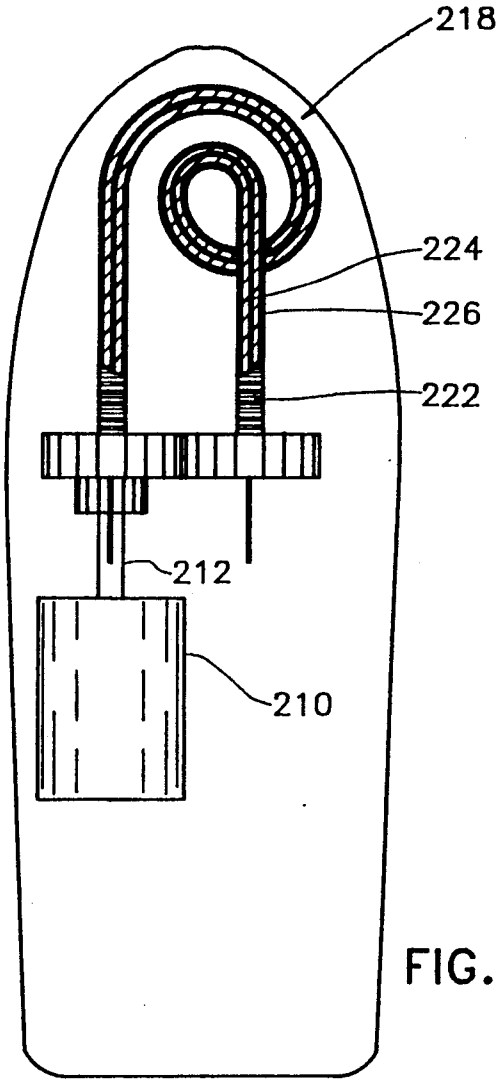
FIGS. 15A and 15B are generalized illustrations of two alternative embodiments of a depilatory device constructed and operative in accordance with another preferred embodiment of the present invention.
Figure 15A:
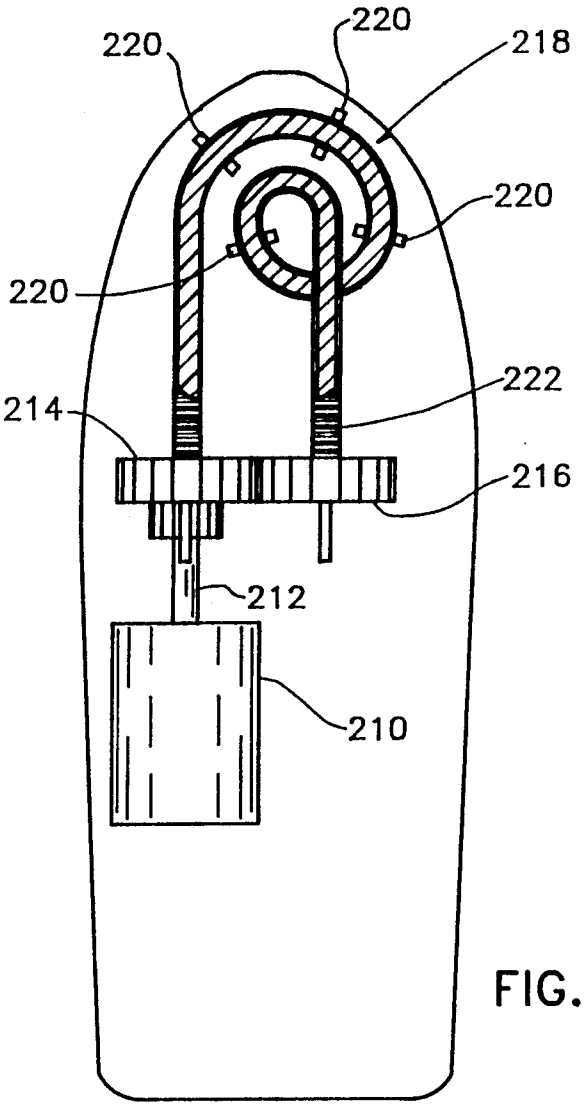

Reference is now made to FIGS. 15A and 15B which illustrate two alternative embodiments of a depilatory device constructed and operative in accordance with a preferred embodiment of the invention. The depilatory device of FIG. 15A includes a driving motor 210 having a drive shaft 212 which drives a first driving gear 214, which drivingly engages a second driving gear 216. Depilatory apparatus 218, typically of the type illustrated in FIGS. 3A and 4A, but alternatively of any suitable type, is driven for rotation by driving gears 214 and 216. The illustrated loop orientation of the depilatory apparatus 218 is preferably maintained by one or more supports 220 which rotatably engage a first element 222 of the depilatory apparatus. Mounting of the depilatory apparatus of FIG. 15A is similar to that illustrated in FIG. 5A.

The embodiment of FIG. 15B is similar to FIG. 15A and accordingly identical reference numerals are used for designating similar structure. In contrast to the structure of FIG. 15A, as illustrated, which employs depilatory apparatus of the general type illustrated in FIGS. 3A and 4A, the apparatus of FIG. 15B employs depilatory apparatus of the general type illustrated in FIGS. 3G, 3H, 4G, 4H, 5B and 5C, including a stationary third element 224 disposed interiorly of and generally coaxially with a second elongate element 226. Mounting of the depilatory apparatus of FIG. 15B is similar to that illustrated in either of FIGS. 5B and 5C, but do not require supports 220.

Reference is now made to FIGS. 16A and 16B which illustrate portions of two alternative versions of an alternative embodiment of the invention, which are particularly characterized in that they produce vibratory motion of the hair engagement element. As seen in FIGS. 16A and 16B, the depilatory device includes a first driving gear 254, which drivingly engages a second driving gear 256. Depilatory apparatus 258, typically of the type illustrated in FIGS. 3A and 4A, but alternatively of any suitable type, is driven for rotation by driving gears 254 and 256.

The illustrated loop orientation of the depilatory apparatus 258 is preferably maintained by a stationary stiffening wire 260. Rotatably mounted for eccentric motion about the stiffening wire 260 is a vibrating drive washer 262 which rotates together with the depilatory apparatus 258, and specifically with the spring 264, relative to stiffening wire 260, thus producing vibratory motion of depilatory apparatus 258. In FIG. 16A, a single such washer 262 is provided, while in FIG. 16B, multiple washers 262 are illustrated, it being understood that any suitable number of such washers may be employed.

Reference is now made to FIGS. 17A–17D, which illustrate the vibratory motion of the depilatory, apparatus 258, and indicate four different typical relative orientations of spring 264 relative to stiffening wire 260. FIG. 18, which is a superimposed illustration of the various relative positions shown in FIGS. 17A–17D, graphically illustrates the vibratory motion, which preferably occurs above 7000 rpm.

Figure 19:
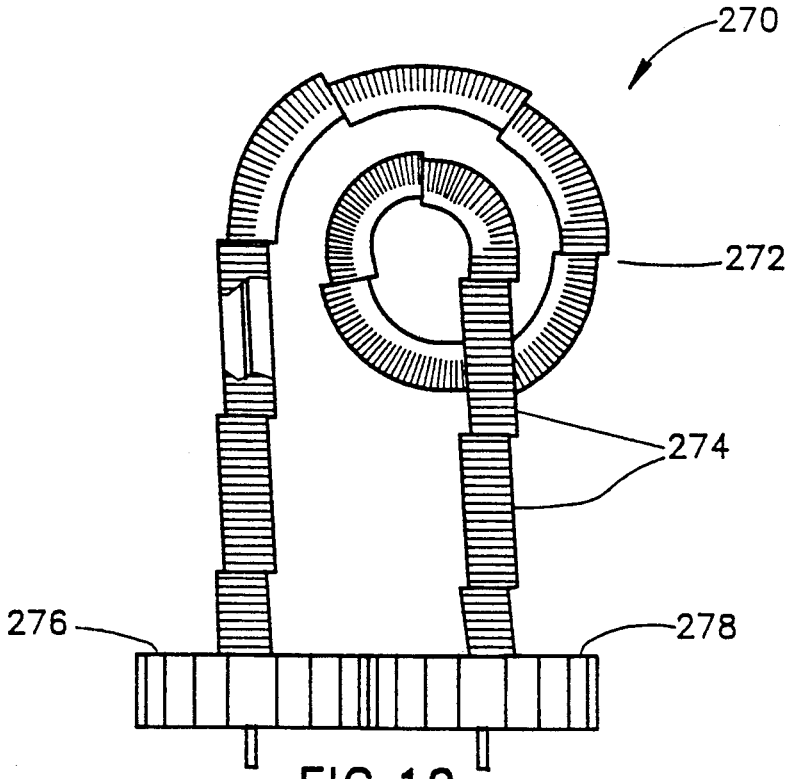
FIG. 19 is an illustration of another embodiment of depilatory device displaying vibratory movement.

Reference is now made to FIG. 19, which illustrates depilatory apparatus 270 which provides vibratory motion during depilation. In this embodiment, a coil spring 272 is bent at intervals to define a plurality of sections 274 which are off-axis with respect to each other, as illustrated. Rotation of the spring 272 produced by rotation of drive gears 276 and 278 produces a vibratory action of the individual sections 274 in the plane of their rotation.

Figure 20:
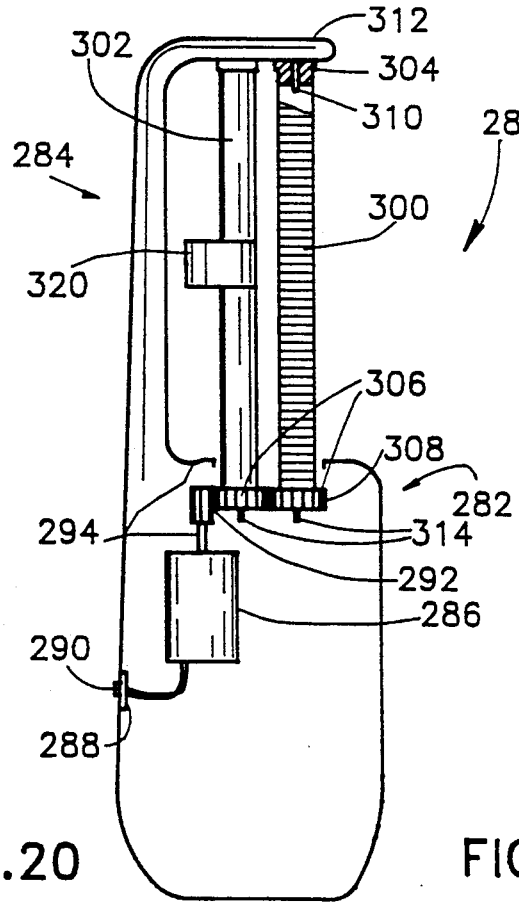
FIGS. 20 and 21 are illustrations of yet another embodiment of depilatory device displaying vibratory movement.
Figure 21:
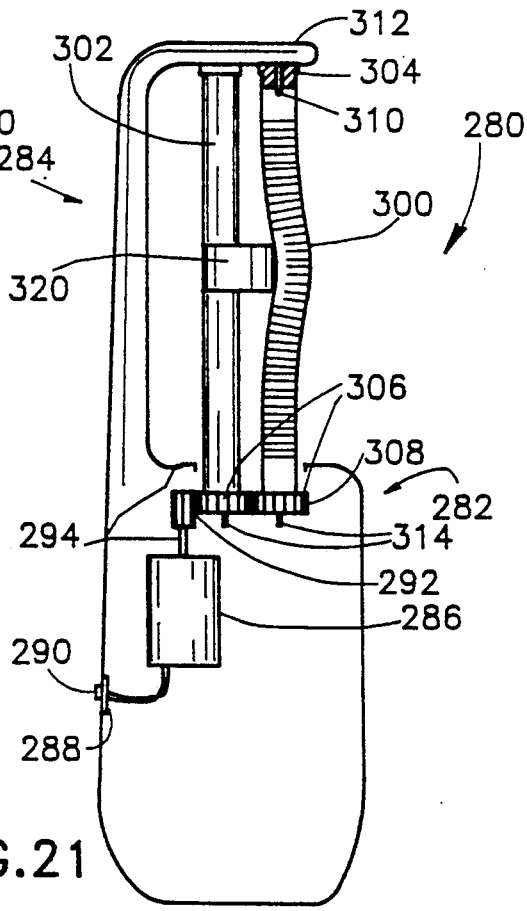

Reference is now made to FIGS. 20 and 21 which illustrate an alternative embodiment of the present invention which provides vibratory motion during depilation. The illustrated apparatus comprises a housing 280, which defines a body portion 282 which is typically integrally formed with an operating head support portion 284.

Mounted interiorly of the body portion 282 of housing 280 is an electric motor 286. The operation of motor 286 is controlled by a manually operable switch plate 288 which is disposed outside of housing 280 and connected to a switch 290 associated with motor 286. Motor 286 drives a gear 292, which is fixedly mounted onto the shaft 294 of motor 286.

A helical spring 300 and an impacting member 302 are fixedly attached at one end thereof to centrally apertured rotatable end members 304 and at an opposite end thereof to apertured end members 306 having gear teeth 308 on their cylindrical edge surfaces.

Helical spring 300 and impacting member 302 are typically rotatably mounted onto housing 280 by means of mounting pins 310 which are fixedly located at an extreme end 312 of head support portion 284 and by means of mounting pins 314 which are fixedly located in housing 280, as illustrated. Mounting pins 310 each rotatably engage an aperture formed in a respective rotatable end member 304 while mounting pins 312 each rotatably engage an aperture formed in a respective rotatable end member 306.

Impacting member 302 is provided with a transversely extending rotatable protrusion 320, which periodically impacts helical spring 300, causing it to be displaced transversely and to have a convex curvature at its outer surface, as illustrated, thereby causing adjacent hair engaging surfaces thereof to be spread apart, as illustrated in FIG. 20. When the helical spring 300 is not engaged by the rotatable protrusion 320, the adjacent hair engaging surfaces of the first element are moved relatively towards each other in hair engaging arrangement.

Figure 9:
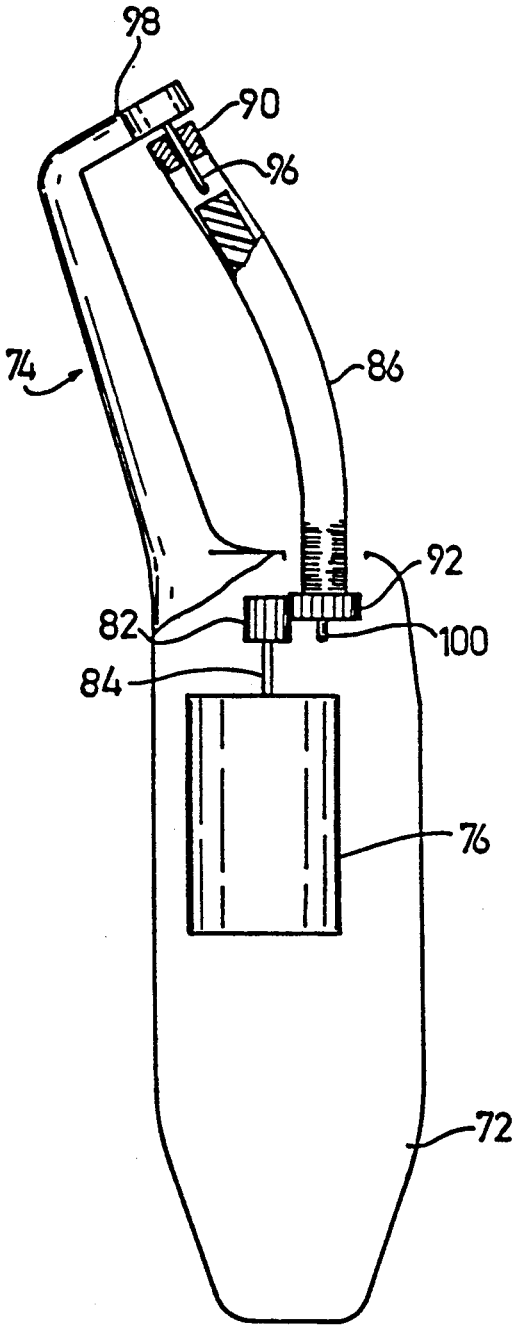
FIG. 9 is a side view of the interior of the depilatory, device of FIGS. 6–8.
Figure 8:
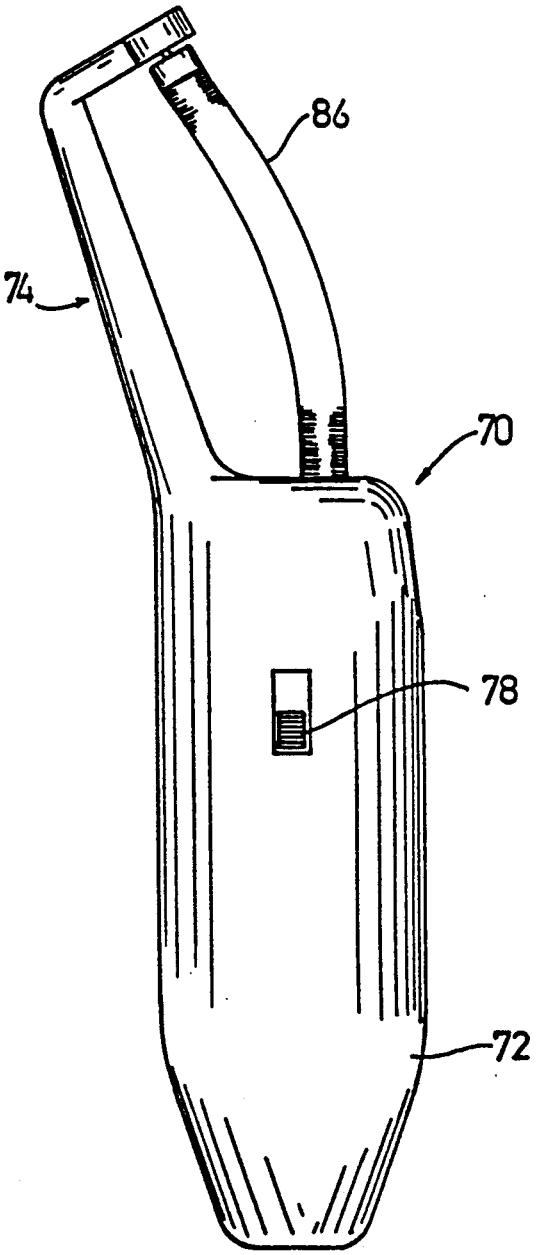
FIG. 8 is a side view of :he exterior of the depilatory device of FIGS. 6 and 7.
Figure 10:
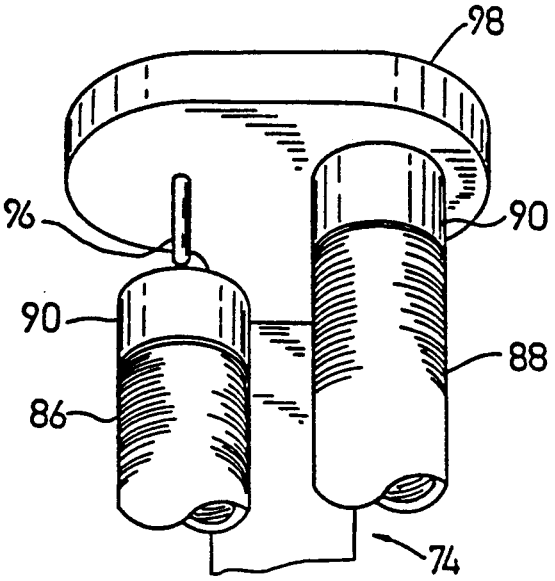
FIG. 10 is a pictorial illustration of the removable engagement of helical springs at a non driven end thereof with the housing of the depilatory device in the embodiment of FIGS. 6–9.
Figure 22A:
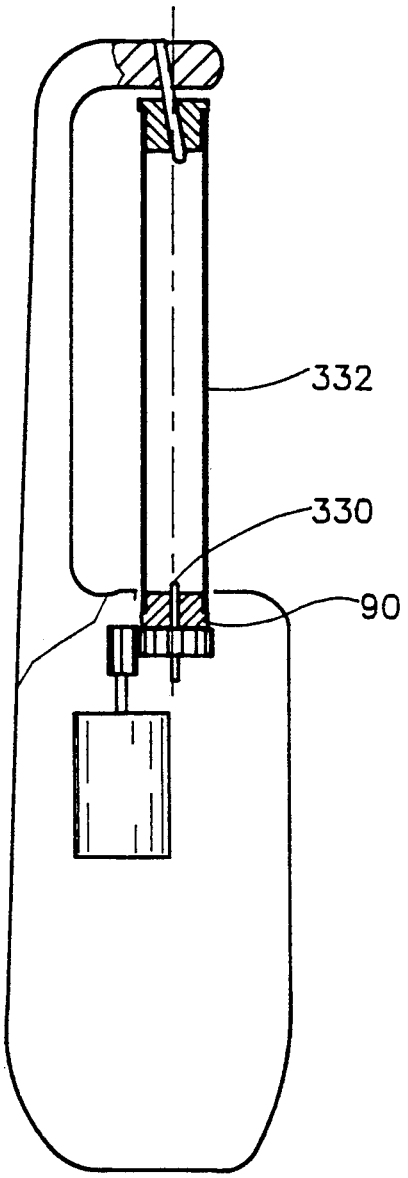
FIGS. 22A and 22B are illustrations of skewed mounting of a hair engagement element for producing vibratory movement during depilation.
Figure 22B:
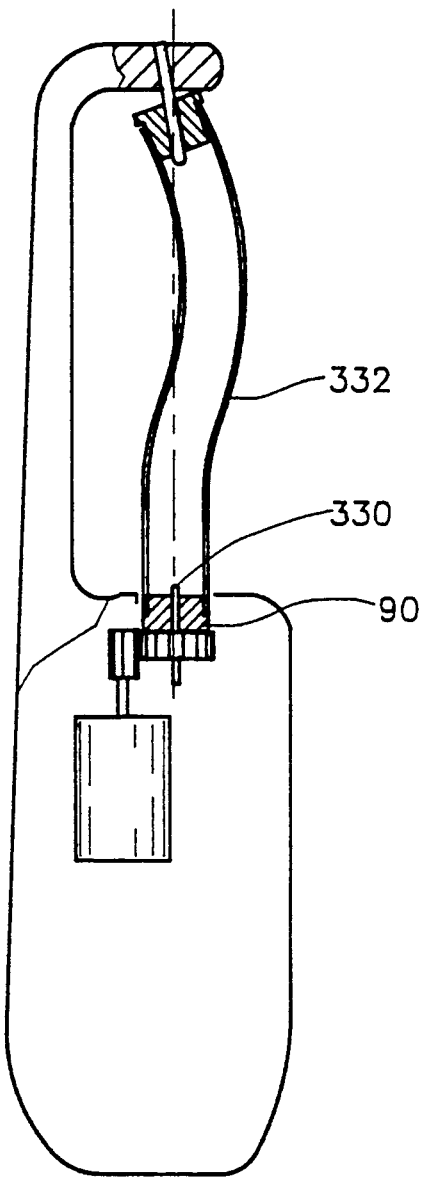

Reference is now made to FIGS. 22A and 22B, which illustrate two alternative orientations of a further alternative embodiment of the invention similar to that illustrated in FIG. 9, but wherein the arrangement of a mounting pin 330 is skewed with respect to rotatable end member 90. Due to this skewed mounting, rotation of the associated helical spring 332 produces time varying undulations of the helical spring, as can be seen by comparing FIGS. 22A and 22B. These time varying undulations are typically periodic and thus provide a vibratory motion during depilation.

It is appreciated that features illustrated herein with reference to separate embodiments can, whenever appropriate, be provided in combination.

It will be appreciated by persons skilled in the art that the present invention is not limited by what has been particularly shown or to the specific type of hair engagement element shown and described hereinabove. Rather the scope of the present invention is defined only by the claims which follow:

We claim:

1. A human hair depilatory device comprising:

a hand held portable housing:

a hair engagement element arranged to be driven in rotational motion relative to skin bearing hair to be removed for engagement and removal of the hair from the skin; and means for causing the hair engagement element to undergo vibration, wherein said means for causing comprises at least one element mounted internally of the hair engagement element and wherein said at least one element comprises a spacer disk eccentrically mounted on a stationary element located within the hair engagement element.

2. A human hair depilatory device according to claim 1 and wherein said hair engagement element comprises a helical spring.

3. A human hair depilatory device comprising:

a hand held portable housing;

a curved hair engagement element arranged to be driven in rotational motion relative to skin bearing hair to be removed, said hair engagement element including a plurality of hair engaging locations at which adjacent hair engaging surfaces of the hair engagement element are spread apart when the hair engaging locations are disposed by rotation at a convex side and at which the adjacent hair engaging surfaces of the first element are moved relatively towards each other in hair engaging arrangement when the hair engaging locations are disposed by rotation at a concave side, the rotational motion of the hair engagement element producing motion of the hair engaging locations from the convex side to the concave side for engagement and removal of hair from the skin; and means for causing the hair engagement element to undergo vibration, wherein said means for causing comprises at least one element mounted internally of the hair engagement element and wherein said at least one element comprises a spacer disk eccentrically mounted on a stationary element located within the hair engagement element.

4. A human hair depilatory device according to claim 3 and wherein said hair engagement element comprises a helical spring.

* * * * *